United States Patent [19]

Yanagawa et al.

[11] 3,946,591

[45] Mar. 30, 1976

[54] METHOD OF AND SYSTEM FOR DETECTING THE RATE OF AN ELECTRONIC TIMEPIECE

[75] Inventors: Yoshihiko Yanagawa, Musashimurayama; Shizuo Yamaguchi, Tokyo, both of Japan

[73] Assignee: Citizen Watch Co., Ltd., Tokyo, Japan

[22] Filed: Jan. 3, 1974

[21] Appl. No.: 430,388

[30] Foreign Application Priority Data

Jan. 10, 1973 Japan ..... 48-5791

[52] U.S. Cl. ..... 73/6

[51] Int. Cl.[2] ..... G04B 17/00; G04D 7/12

[58] Field of Search ..... 73/6; 58/23 R

[56] References Cited

UNITED STATES PATENTS

| | | | |
|---|---|---|---|
| 2,748,595 | 6/1956 | Hetzel | 73/6 |
| 2,931,217 | 4/1960 | Wenot et al. | 73/6 |
| 3,756,013 | 9/1973 | Bergey et al. | 58/23 R X |
| 3,811,314 | 5/1974 | Anouchi | 73/6 |
| 3,838,564 | 10/1974 | Holcomb | 58/23 AC |

FOREIGN PATENTS OR APPLICATIONS

| | | | |
|---|---|---|---|
| 1,033,824 | 6/1966 | United Kingdom | 73/6 |

*Primary Examiner*—Richard C. Queisser
*Assistant Examiner*—John S. Appleman
*Attorney, Agent, or Firm*—Ernest G. Montague; Karl F. Ross; Herbert Dubno

[57] ABSTRACT

The operating speed of an electronic timepiece, whose electro-optical indicator is excited by an oscillator with a frequency harmonically related to its stepping rate, is determined by an electrostatic sensor including a monitoring plate capacitively coupled to an electrode of the indicator. The output of the sensor is a bipolar pulse train developed across a resistor defining a differentiation circuit of small time constant with the condenser formed by the monitoring plate and the electrode, the capacitance of this condenser being on the order of 1 pf or less so that the controlling oscillator is not significantly loaded by the presence of the sensor.

5 Claims, 5 Drawing Figures

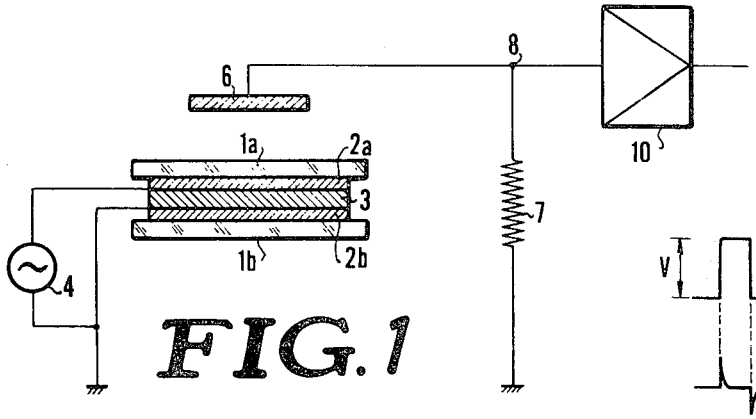
FIG. 1
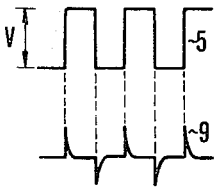
FIG. 2
FIG. 3
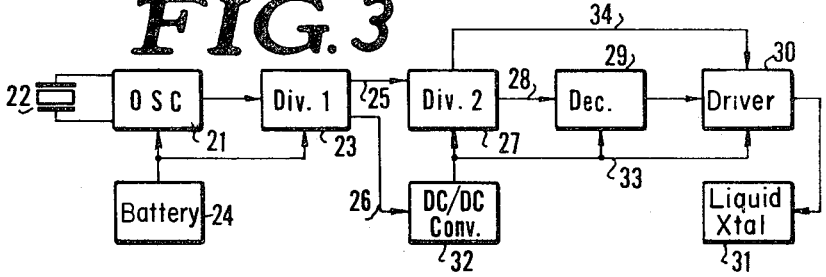
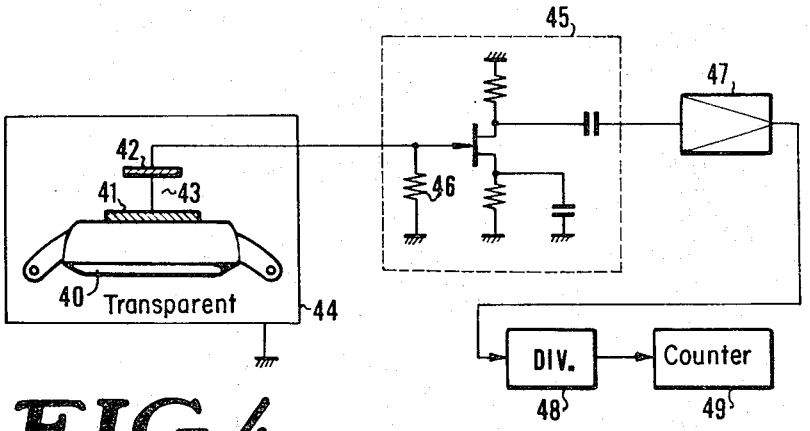
FIG. 4
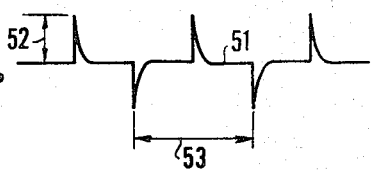
FIG. 5

METHOD OF AND SYSTEM FOR DETECTING THE RATE OF AN ELECTRONIC TIMEPIECE

FIELD OF THE INVENTION

This invention relates to a method of a system for determining the operating speed or rate of an electronic watch comprising a time indicator which makes use of an electro-optic display element such as a liquid crystal, a light diode or the like.

BACKGROUND OF THE INVENTION

The art of chronometry has developed from a mechanical watch, comprising a spring as its power source, to a battery-powered watch comprising an electromagnetically driven tuning fork or hairspring balance and crystal to a crystal timepiece comprising a crystal oscillator which can generate a high-frequency signal as a time standard. There has also been developed a totally electronic watch which makes use of an electro-optic display element such as a liquid crystal or a light-emitting diode for displaying time and is not provided with movable parts at all.

In prior-art systems for determining the rate of a mechanical watch, the vibrations or impacts of an oscillating body incorporated in the clockwork - i.e. its ticks are detected acoustically by means of a microphone arranged outside the watch case. In a conventional system serving to determine the rate of a watch controlled by a tuning fork, having a high oscillating frequency and low ticks, or of an electromagnetically driven watch whose clockwork does not produce ticks, the generated magnetic leakage flux is electromagnetically detected by means of a monitoring coil positioned outside the watch case.

In the totally electronic watch which does not produce any tick or magnetic leakage flux, it is impossible to measure the rate acoustically or electromagnetically by the aforedescribed methods. In this case, it is known to provide a lead extending through the watch case to deliver a rate signal to an external speed sensor. This conventional method, however, has the disadvantages that a circuit incorporated in the watch case is liable to be subjected to outside disturbances, that the monitoring lead occupies additional space, and that the watch must be connected through a conductor to the speed sensor every time the rate measurement is to be carried out. Thus, this prior - art method is unsuitable for testing watches on an large scale.

OBJECT OF THE INVENTION

The object of our present invention, therefore, is to provide an improved method of and means for monitoring the operating speed of an electronic timepiece whose visual indicator is excited by an applied alternating voltage of fixed frequency and is stepped at a rate harmonically related to that frequency.

We realize this object, in accordance with the present invention, by closely juxtaposing a conductive monitoring plate with an electrode of the time indicator of an electronic timepiece to be tested, the plate and the electrode forming a low-capacitance condenser whose junction with a large resistor constitues an output terminal where a bipolar pulse train, derived from the exciting voltage by differentiation, is available for transmission to a counter which forms part of a conventional rate meter measuring the recurrence rate of the pulses.

BRIEF DESCRIPTION OF THE DRAWING

The above and other features of our invention will now be described in greater detail with reference to accompanying drawing wherein:

FIG. 1 shows schematically an embodiment of a speed-sensing system for an electronic watch which makes use of a liquid-crystal display cell;

FIG. 2 is a graphic representation of the phase relationship between a voltage wave driving the liquid crystal shown in FIG. 1 and a pulse train detected;

FIG. 3 is a block diagram of the circuit arrangement of a crystal-oscillator-type watch utilizing the liquid-crystal display cell shown in FIG. 1;

FIG. 4 schematically illustrates details of the speed sensor shown in FIG. 1; and FIG. 5 is a graphic representation of a train of voltage pulses detected by the system shown in FIG. 4.

DETAILED DESCRIPTION OF THE INVENTION

In FIG. 1 we have shown a speed-sensing system according to the invention applied to a watch wherein a liquid crystal display device is used. An embodiment of the liquid crystal display device shown in FIG. 1 comprises two parallel glass substrates 1*a* and 1*b* provided at their inner surfaces with electrodes 2*a* and 2*b*, respectively, forming a gap therebetween. Between the electrodes 2*a* and 2*b* is sandwitched a liquid crystal substance 3. One of the electrodes 2*a* is made transparent. If an electric field is applied across both the electrodes 2*a* and 2*b*, the liquid crystal substance 3 is electro-optically modulated to display letters or figures in response to the electrode pattern.

In general, the electric field applied across both the electrodes 2*a* and 2*b* is of an alternating electric field on the order of several volts to several tens volts as determined by taking the life of the liquid crystal into consideration and hence the output voltage wave delivered from an electric power supply source 4 and for driving the liquid crystal 3 is of a rectangular wave 5 as shown in FIG. 2.

In accordance with the invention, provision is made of a metal plate 6 arranged near the liquid crystal display with parallel to exciting electrode 2*a* and spaced apart from its carrier plate 1*a*. The electrode 2*b* is directly connected to ground while the metal plate 6 is grounded through a terminal 8 and a resistor 7.

When the electric field is applied across the electrodes 2*a* and 2*b*, the potential of the electrode 2*a* changes from O to V as shown by the voltage wave 5 in FIG. 2 to electrostatically induce an electric charge on the metal plate 6. The resulting output voltage at the terminal 8 is a pulse train 9 having the waveform shown in FIG. 2.

Thus, the cell electrode 2*a* and the metal plate 6 constitute a condenser having a very small capacitance through which the output at oscillator 4 is electrostatically transmitted to the resistor 7. As a result, the exciting voltage wave 5 is differentiated into the voltage wave 9. If the voltage wave 5 is a square wave with steep flanks, the pulse amplitude of train 9 approaches the peak voltage V wave 5.

The waveform 9 depends on the time constant determined by the capacitance 2*a*, 6 and by the magnitude of resistor 7. If this time constant is very small compared with the period of the voltage wave 5, the voltage wave 9 becomes a series of sharp spikes.

The aforementioned capacitance 2*a*, 6 can be on the order of 0.01 to 1 pf, and the value of the resistor 7 can be on the order of 1 to 100 MΩ, which can be easily realized.

Owing to the high-impedance electrostatic coupling between the resistor 7 and the oscillator 4 through a capacitance of not more than 1 pf, only a small load current drawn from the oscillator 4 whose stability, therefore, is not degraded. In addition, the liquid-crystal display cell is not adversely affected by the presence of a large shunt capacitance.

Experimental tests have shown that if the peak voltage delivered by the oscillator 4 is 5 V, the dimension of the metal plate 6 is 5 mm × 5 mm × 0.3 mm (thickness) and the gap between the electrode 2a and the metal plate 6 is at least 2mm, then the capacitance of members 2*a* and 6 is on the order of 0.1 pf, and that if the value of the load resistor 7 and 1 MΩ, the peak output voltage at the terminal 8 is 50 mV. In FIG. 1, reference numeral 10 designates an amplifier and wave shaper.

In a watch whose clockwork comprise an oscillator controlled by a crystal or a tuning fork, and the natural frequency of the crystal or the tuning fork determines the rate of the watch. The signal delivered to each digit position of the time display device indicator changes every second, minute or hour with a precision depending upon the stability of the oscillator frequency. The bipolar pulse train 9 of the same fundamental frequency triggers the amplifier 10 to allow rapid masurement of the rate of the watch. the alternating In FIG. 3 we have shown an embodiment of our invention wherein an oscillator 21 is controlled by a crystal 22 and adapted to deliver a stable alternating voltage to a first frequency divider 23. Reference numeral 24 designates a battery adapted to operate as an electric power supply with an output of 1.5 V. The first frequency divider 23 has two outputs 25 and 26. The output 25, at a frequency of 64 Hz, is delivered to a second frequency divider 27 which feeds one pulse 28 per minute to a 7-segment decoder 29 from which a 7-segment digital display signal is delivered through a divider 30 to a liquid-crystal display device 31. Thus, decoder 29 is stepped at a rate of 1/60 Hz to change the pattern of energization of display 31, as is well known per se.

The output 26, at a frequency of 256 Hz, is delivered to a bootstrap type DC/DC converter 32 feeding a high direct-current voltage 33 of 7 V to the second frequency divider 27, decoder 29 and driver 30 in parallel.

The second frequency divider 27 delivers an output signal 34 of 32 Hz to the driver 30 which supplies an alternating voltage of 7 V to the display device 31. The exciting frequency of voltage 34 is therefore harmonically related to the stepping rate determined by the signal 28.

FIG. 4 illustrates a circuit arrangement which can detect the rate of a watch 40 provided with the sensor shown in FIG. 3. A metal plate 42 is arranged above a display window 41 of watch 40. A gap 43 formed between the display window 41 and the metal plate 42 has a width of up to 1 mm. The watch 40 and the metal plate 42 are surrounded by a simple electrostatic shield 44. In the present embodiment, a sufficient electrostaic shielding effect is obtained by using a thin aluminum sheet as the enclosure 44.

The metal plate 42 is connected to an amplifier 45 including a junction-type field-effect transistor. A load resistor 46 connected to the elctrostatic-pickup plate 42 has a magnitude of 1 MΩ and the dimensions of that plate are 5 mm × 5mm × 0.3 mm (thickness). If the gap 43 is about 1 mm, the waveform 51 of the monitoring voltage developed across the resistor 46 is again a bipolar pulse train as shown in FIG. 5. The detecting voltage has a peak value 52 of 40 mV and a period 53 of 31,250 μsec(32 Hz).

The output from the amplifier 45 is delivered through a wave shaper 47 to a $\frac{1}{2^5}$ frequency divider 48 by which the frequency is stepped down to a nominal value of 1 Hz. The output from the frequency divider 48 is delivered to a counter 49 which forms part of a conventional rate meter.

In a specific instance, the deviation from the nominal frequency was found to be not more than $1 \times 10^{-7}$ per 10 periods on the average. This stability calculated in terms of daily difference, corresponds to a gain or loss of at most 0.01 sec/day which is considered a sufficiently high degree of precision.

In another instance, metal plate 42 used as a monitoring electrode is replaced by a glass plate of 10 mm × 10 mm × 0.5 mm (thickness) and covered at one surface with a transparent electrically conductive film of $SnO_2$ which gives the same satisfactory results as the aforedescribed arrangement. Moreover, the use of a transparent electrode plate 42 renders it possible to detect the rate of the watch 40 while reading the time displayed its luminous indicator.

The electro-optical display element used as the time indicator of the electronic watch need not be a liquid-crystal cell. The invention may be applied to any other luminous display elements driven by an electric field such, for example, as light-emitting diodes, plasma displays, electro-chromic displays, electroluminescent displays and the like. Because of its low energy consumption, the speed-monitoring system according to our invention is simple in construction and highly precise in operation.

What is claimed is:

1. A system for determining the operating speed of a timepiece provided with an oscillator of fixed frequency, electro-optical indicator means including an exciting electrode, stepping means for said indicator means controlled by said oscillator means, and circuit means connected to said oscillator for applying to said exciting electrode an alternating voltage harmonically related to the stepping rate of said indicator means, comprising a conductive plate spacedly juxtaposed with said exciting electrode for defining therewith a coupling capacitance, a resistance connected to said capacitance for developing thereacross a voltage wave in step with said alternating voltage, amplifier means connected across said resistance, and rate-metering means connected to said amplifier means.

2. A system as defined in claim 1 wherein said indicator means comprises a liquid-crystal cell.

3. A system as defined in claim 1 wherein said capacitance and said resistance define a differentiation circuit with a time constant which is small compared to the period of said alternating voltage.

4. A system as defined in claim 3 wherein said resistance has a magnitude on the order of megohms and said capacitance is on the order of, at most, 1 pf.

5. A system as defined in claim 1 wherein said plate and said electrode are both transparent for enabling viewing of said indicator means during speed determination.

* * * * *